US007253348B2

(12) United States Patent
Stanley

(10) Patent No.: US 7,253,348 B2
(45) Date of Patent: Aug. 7, 2007

(54) GUITAR GRIPPING APPARATUS

(76) Inventor: Paul Stanley, Janvey, Gordon, Herlands, Randolph, 355 Lexington Ave., New York, NY (US) 10017

( * ) Notice: Subject to any disclaimer, the term of this patent is extended or adjusted under 35 U.S.C. 154(b) by 0 days.

(21) Appl. No.: 11/106,113

(22) Filed: Apr. 14, 2005

(65) Prior Publication Data

US 2006/0230905 A1 Oct. 19, 2006

(51) Int. Cl.
*G10D 3/18* (2006.01)

(52) U.S. Cl. ..... 84/328; 473/551

(58) Field of Classification Search ..... 84/328, 84/267, 327, 291, 453; 473/551, 568, 457; D17/14

See application file for complete search history.

(56) References Cited

U.S. PATENT DOCUMENTS

| | | | | |
|---|---|---|---|---|
| 3,868,110 | A | 2/1975 | Jones | |
| 4,339,981 | A | 7/1982 | Smith | |
| D273,500 | S * | 4/1984 | Dornan | D17/18 |
| 4,890,355 | A | 1/1990 | Schulten | |
| D308,216 | S * | 5/1990 | Harriott | D17/14 |
| 5,315,910 | A * | 5/1994 | Soupios | 84/453 |
| 5,482,270 | A | 1/1996 | Smith | |
| 5,577,722 | A | 11/1996 | Glassberg | |
| 5,588,651 | A | 12/1996 | Frost | |
| 5,867,868 | A | 2/1999 | Ward | |
| 6,101,086 | A | 8/2000 | Kim et al. | |
| 6,323,409 | B1 * | 11/2001 | Surber | 84/453 |
| D474,227 | S | 5/2003 | Wilson | |
| 6,573,439 | B2 | 6/2003 | Wilson | |
| 6,703,546 | B1 | 3/2004 | Wilson | |
| D499,757 | S * | 12/2004 | Hoffman | D17/14 |
| 2001/0046559 | A1 | 11/2001 | Hewitson | |
| 2002/0104424 | A1 * | 8/2002 | Spalt | 84/291 |
| 2003/0037659 | A1 * | 2/2003 | Wilson | 84/291 |
| 2003/0217635 | A1 * | 11/2003 | Christou | 84/327 |

FOREIGN PATENT DOCUMENTS

| | | |
|---|---|---|
| WO | WO 02/30731 A1 | 4/2002 |
| WO | WO 2004/050343 A1 | 6/2004 |

* cited by examiner

*Primary Examiner*—Lincoln Donovan
*Assistant Examiner*—Jianchun Qin
(74) *Attorney, Agent, or Firm*—RatnerPrestia

(57) ABSTRACT

Apparatus to grip a guitar with a hand of a user and a guitar including such apparatus are disclosed. The guitar includes a main body and a horn extending from the main body. The horn includes at least one feature adapted to conform to the hand of the user. The features of the horn may be formed as part of the guitar or may be added to the horn of the guitar after formation of the guitar.

14 Claims, 7 Drawing Sheets

FIG. 3
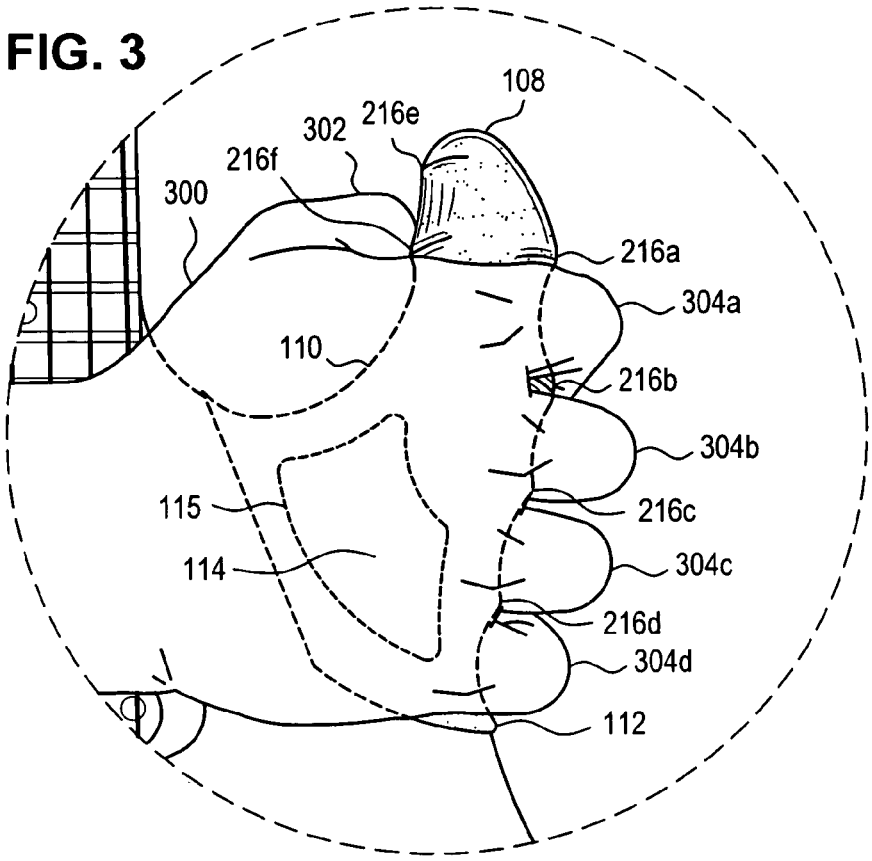
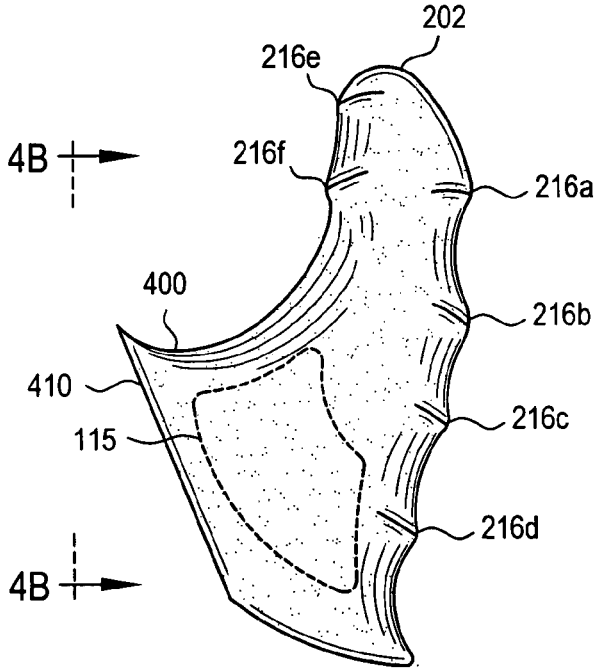
FIG. 4A
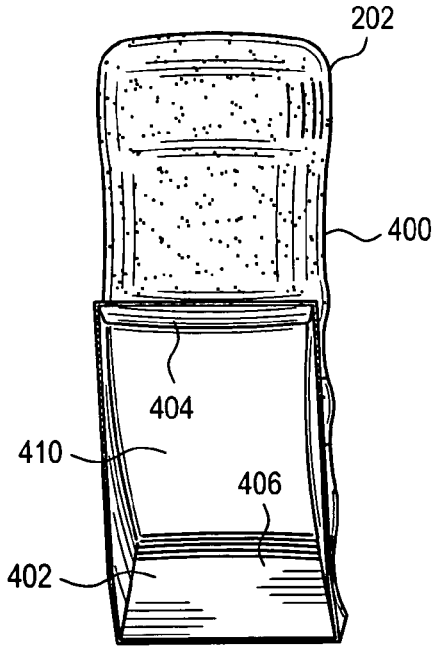
FIG. 4B

GUITAR GRIPPING APPARATUS

BACKGROUND OF THE INVENTION

The present invention relates generally to guitars and, more particularly, to apparatus for gripping a guitar.

FIG. 10 depicts a conventional electric guitar 10. The guitar 10 includes a main body 12 and a neck 14 extending from the main body 12. An upper cutaway 16 creates an upper horn 18 that extends from the main body 12 and a lower cutaway 20 creates a lower horn 22 that extends from the main body 12. Guitars such as guitar 10 typically have a smoothly polished surface.

It is often necessary to maneuver the guitar 10 (particularly the neck 14 of the guitar 10) around obstacles and through crowded areas and narrower passages, e.g., when transporting the guitar 10 between a dressing room and a stage for a performance. The smoothly polished surface of the guitar 10 makes it difficult to securely grip the guitar 10 with a hand of a user, which inhibits the user's ability to maneuver the guitar 10. This problem is further exacerbated by perspiration that may develop during performances with the guitar 10.

Accordingly, there is a need for apparatus to facilitate gripping a guitar. The present invention addresses this need among others.

SUMMARY OF THE INVENTION

The present invention is embodied in apparatus for gripping a guitar with a hand of a user and in a guitar including such apparatus. The guitar includes a main body and a horn extending from the main body. The horn includes at least one feature adapted to conform to the hand of the user. The features of the horn may be formed as part of the guitar or may be added to the horn of the guitar after formation of the guitar.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. This emphasizes that according to common practice, the various features of the drawings are not drawn to scale. On the contrary, the dimensions of the various features are arbitrarily expanded or reduced for clarity. Included in the drawings are the following figures:

FIG. 3 is an exploded view of the lower horn of the exemplary guitar of FIG. 1 with a hand positioned thereon;

FIG. 4A is a front view of an exemplary sleeve for placement on a lower horn of a guitar in accordance with an aspect of the present invention;

FIG. 4B is a side view of the exemplary sleeve in FIG. 4A;

DETAILED DESCRIPTION OF THE INVENTION

Figure 1:
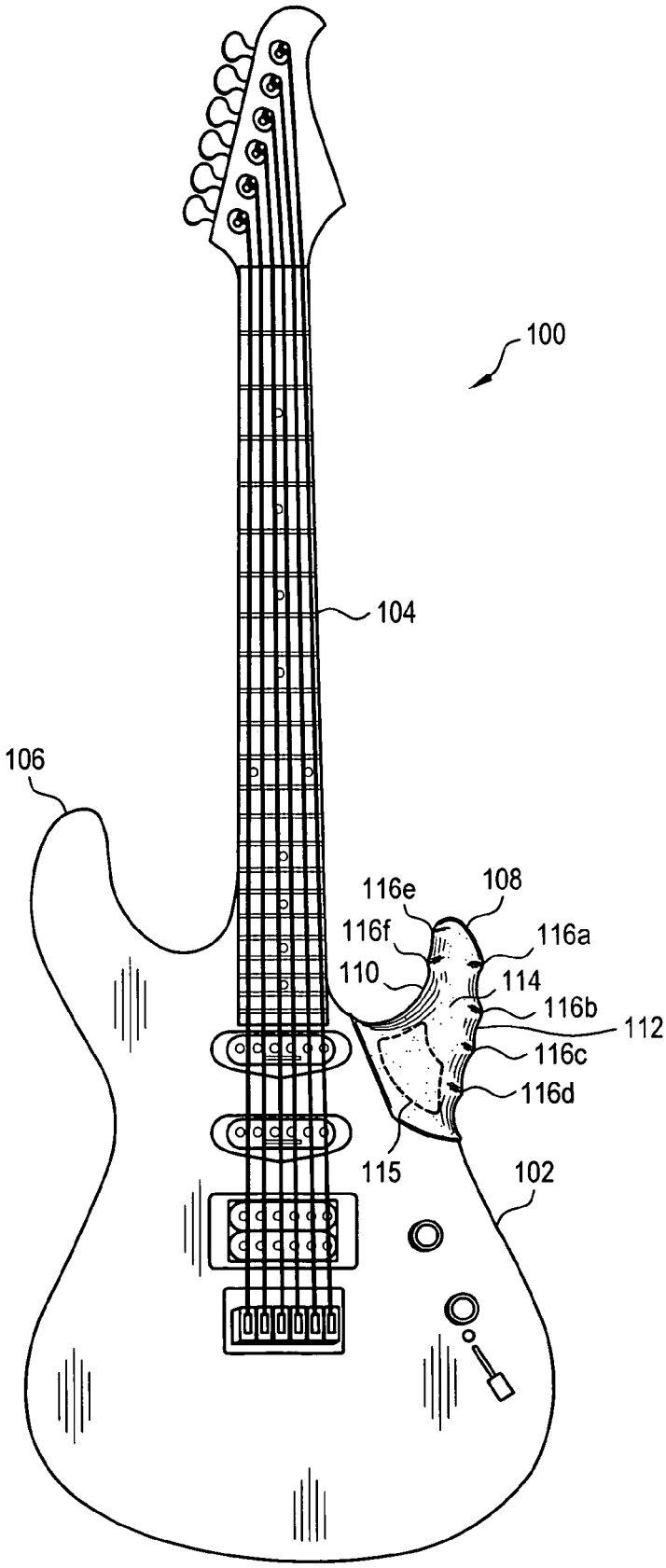
FIG. 1 is a front view of an exemplary guitar in accordance with an aspect of the present invention.

FIG. 1 depicts an exemplary guitar 100 for use in describing the present invention. The guitar 100 includes a main body 102 and a neck 104 extending from the main body 102. An upper horn 106 and a lower horn 108 also extend from the main body 102. The terms upper horn 106 and lower horn 108 refer to the typical relative positions of the horns 106/108 during use of the guitar 100.

The lower horn 108 includes an inner portion 110 that faces the neck 104 of the guitar 100 and an outer portion 112 that faces away from the neck 104 of the guitar 100. The lower horn 108 further includes a front portion 114 positioned between the inner portion 110 and the outer portion 112. In an exemplary embodiment, the inner portion 110 is at least partially concave, and the outer portion 112 and the front portion 114 are at least partially convex. In alternative exemplary embodiments, the inner portion 110 and/or the outer portion 112 may have other shapes, e.g., substantially straight.

The lower horn 108 includes at least one feature adapted to conform to the hand of a user to facilitate gripping the guitar 100. As used herein, the phrase "conform to" means to correspond in form either similarly or identically. In an exemplary embodiment, one or more of the at least one feature is shaped to conform to the hand of the user. In alternative exemplary embodiments, one or more of the at least one feature deforms in order to conform to the hand of the user, which is described in further detail below. Suitable materials and techniques for forming the lower horn 108 will be understood by those of skill in the art from the description herein.

Figure 2A:
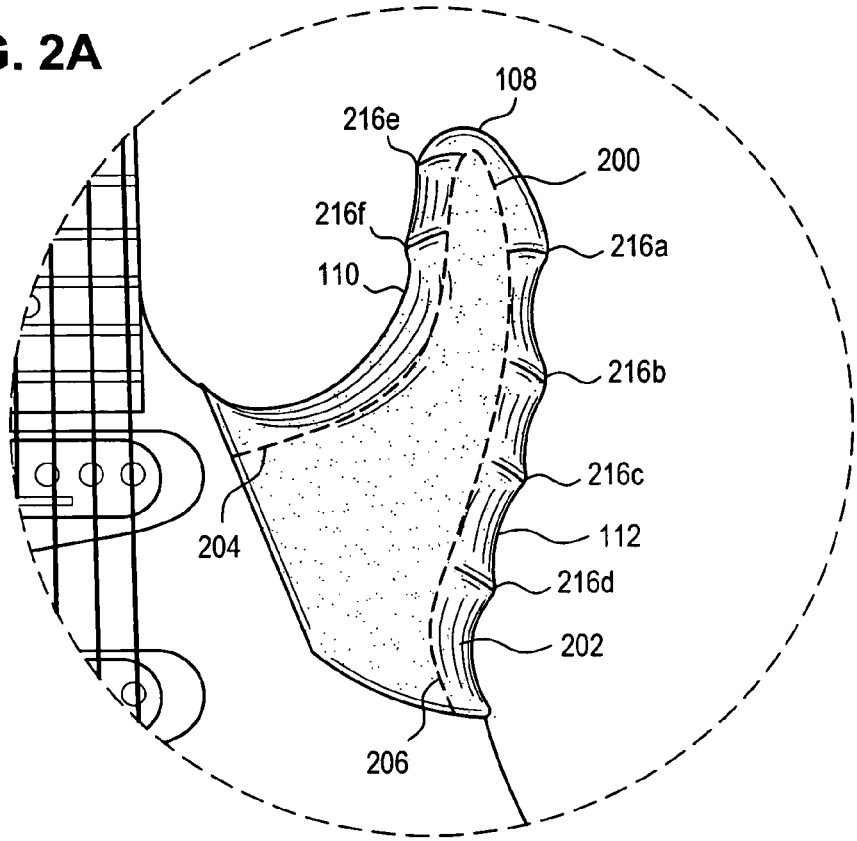
FIG. 2A is an exploded view of the lower horn of the exemplary guitar of FIG. 1.

In an exemplary embodiment, the at least one feature adapted to conform to the hand of the user is a plurality of ridges positioned on the lower horn 108 (represented by ridges 116*a-f* in the illustrated embodiment). Additionally, the at least one feature may further include a raised portion 115 on the front portion 114 (e.g., a convex shape of the front portion 114) adapted to conform to the palm of the hand of the user. FIG. 2A depicts an exploded view of the lower horn 108 of the guitar 100 and FIG. 3 depicts the lower horn 108 with a hand 300 positioned thereon. The hand 300 includes a thumb 302 and a plurality of fingers 304*a-d*.

The lower horn 108, as illustrated in FIGS. 2A and 3, includes four ribs 216*a-d* on the outer portion 112 of the lower horn 108 and two ribs 216*e* and 216*f* on the inner portion 110 of the lower horn 108 that form the plurality of ridges 116 (FIG. 1) on the lower horn 108. In an exemplary embodiment, at least one rib (e.g., ribs 216*a-d*) on the outer portion 112 of the lower horn 108 is adapted to abut one or more fingers (e.g., fingers 304*a-d*) of the hand 300 of the user when the user grasps the lower horn 108. Additionally, at least one rib (e.g., rib 216*f*) on the inner portion of the lower horn 108 is adapted to abut the thumb 302 of the hand 300 of the user when the user grasps the lower horn 108. The ribs 216 of the lower horn 108 are a feature of the lower horn 108 adapted to conform to the hand 300 of the user when the user grasps the lower horn 108. This enables a user to firmly grip the lower horn 108 of the guitar 100 with their hand 300 in order to facilitate maneuvering of the guitar 100.

In an exemplary embodiment, the lower horn 108 with the at least one feature is formed during the formation of the main body 102. The formed lower horn 108 may be coated with a gripping material such as rubber to further enhance the ability to grip the lower horn 108. In an alternative exemplary embodiment, the at least one feature may be a sleeve added to a lower horn base 200, e.g., after formation of the main body 102 and the lower horn base 200 or as an aftermarket add-on to a conventional lower horn 22 (FIG. 10) that becomes the lower horn base 200 for the sleeve.

FIGS. 4A and 4B depict an exemplary sleeve 202 that may be added to a lower horn base 200. The sleeve 202 includes an outer surface 400 and an inner surface 402. The sleeve 202 further includes an opening 410 on at least one end for receiving the lower horn base 200. The sleeve 202 may optionally have an opening on a second end such as illustrated in FIG. 9C. The outer surface 400 of the sleeve 202 includes ribs 216*a-f* adapted to abut the thumb 302 and fingers 304*a-d* of the hand 300 when the sleeve 202 is positioned on the lower horn base 200 (FIG. 2A) and the user grasps the sleeve 202 positioned on the lower horn base 200. The exemplary sleeve 202 may be held in place on the lower horn base 200 in a conventional manner, e.g., with an adhesive or through friction.

In an exemplary embodiment, the inner surface 402 of the sleeve 202 includes an inner edge portion 404 for mating with an inner base portion 204 of the lower horn base 200 and an outer edge portion 406 for mating with an outer base portion 206 of the lower horn base 200. The inner base portion 204 may be concave and the inner edge portion 404 may be convex to receive the concave inner base portion 204. Additionally, the outer base portion 206 may be convex and the outer edge portion 406 may be concave to receive the convex outer base portion 206. In an alternative exemplary embodiment, the inner surface 402 may be circular with the sleeve deforming to mate with the lower horn base 200.

Figure 2B:
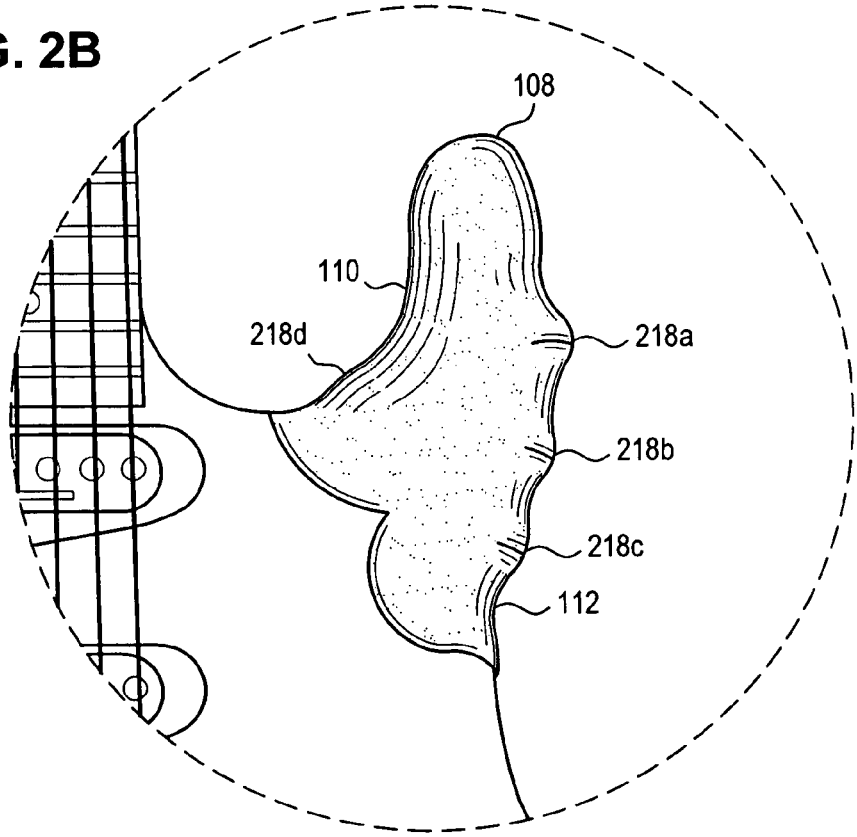
FIG. 2B is an exploded view of an alternative exemplary lower horn in accordance with an aspect of the present invention.

FIG. 2B depicts an alternative exemplary lower horn 108 of the guitar 100. The lower horn 108 of FIG. 2B includes three ribs 218*a-c* on the outer portion 112 of the lower horn 108 and one rib 218*d* on the inner portion 110 of the lower horn 108. At least one rib (e.g., ribs 218*a-c*) on the outer portion 112 of the lower horn 108 is adapted to abut one or more of the fingers (e.g., fingers 304*a-d* of FIG. 3) when the user grasps the lower horn 108. Additionally, the rib 218*d* on the inner portion 110 of the lower horn 108 is adapted to abut the thumb 302 when the user grasps the lower horn 108. The ribs 218 of the lower horn 108 are a feature of the lower horn 108 adapted to conform to the hand 300 of the user when the user grasps the lower horn 108. This enables a user to firmly grip the lower horn 108 of the guitar 100 with their hand 300 in order to facilitate maneuvering of the guitar 100. The embodiments described above with reference to the lower horn 108 of FIGS. 2A and 3 are applicable to the alternative exemplary lower horn 108 depicted in FIG. 2B.

Figure 5:
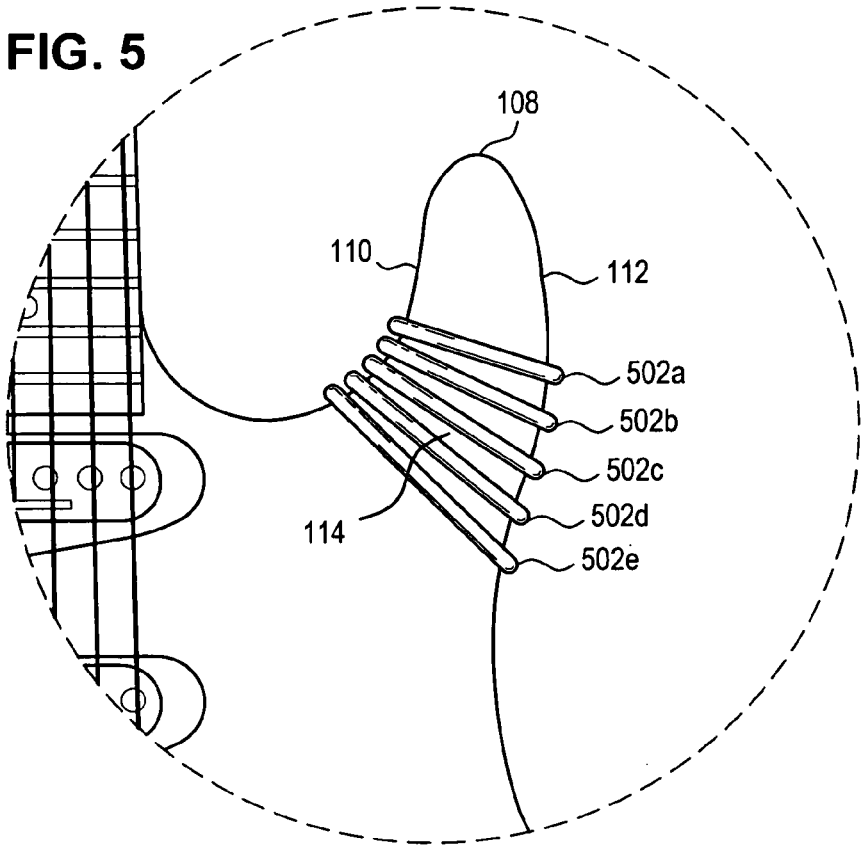
FIG. 5 is a front view of an alternative exemplary lower horn in accordance with an aspect of the present invention.
Figure 10:
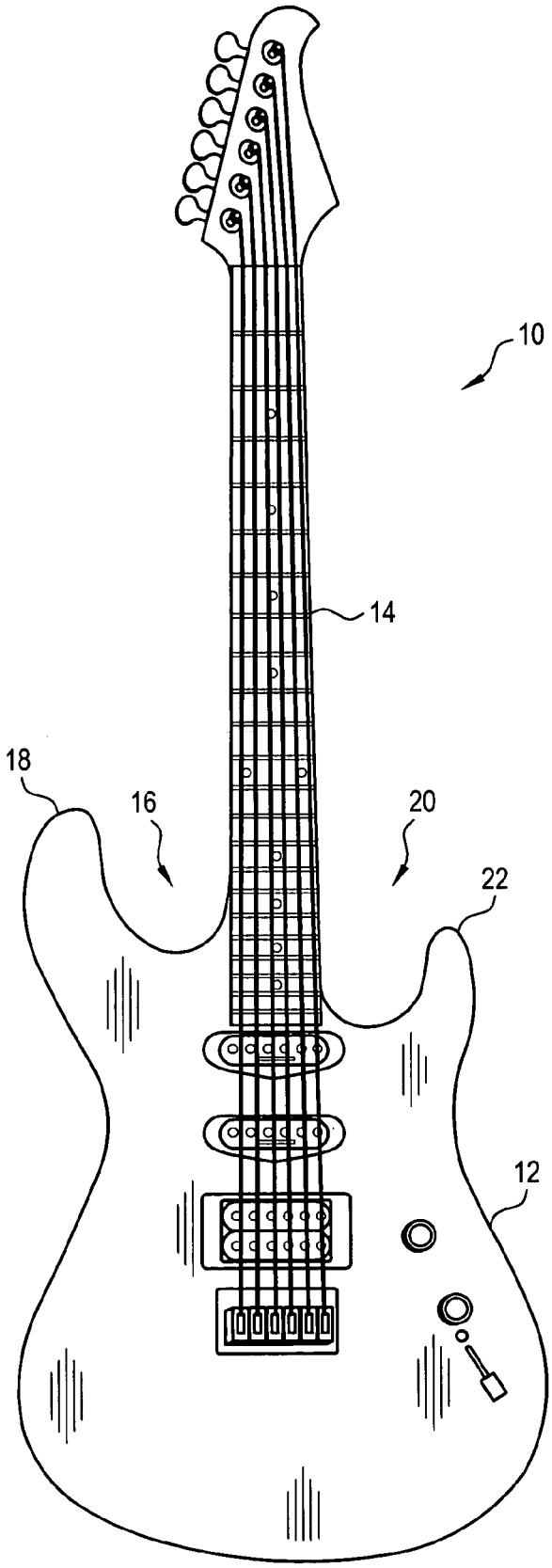
FIG. 10 is a front view of a prior art guitar.

FIG. 5 depicts an alternative exemplary lower horn 108 of the guitar 100. The lower horn 112 includes a plurality of rings (represented by five rings 502*a-e*) that encircle the lower horn 108 and form the plurality of ridges 116 (FIG. 1) on the lower horn 108. At least one of the rings 502 is adapted to conform to the fingers (e.g., fingers 304*a-d* of FIG. 3) and/or the thumb 302 of the hand 300 of the user when the user grasps the lower horn 108. Additionally, at least one of the rings 502 is adapted to conform to the palm of the hand 300, e.g., along the front surface 114 of the lower horn 108, when the user grasps the lower horn 108. The rings 502 may be added to the lower horn 208 at the time of manufacture or as an aftermarket add-on to a conventional lower horn 22 (FIG. 10).

Figure 6:
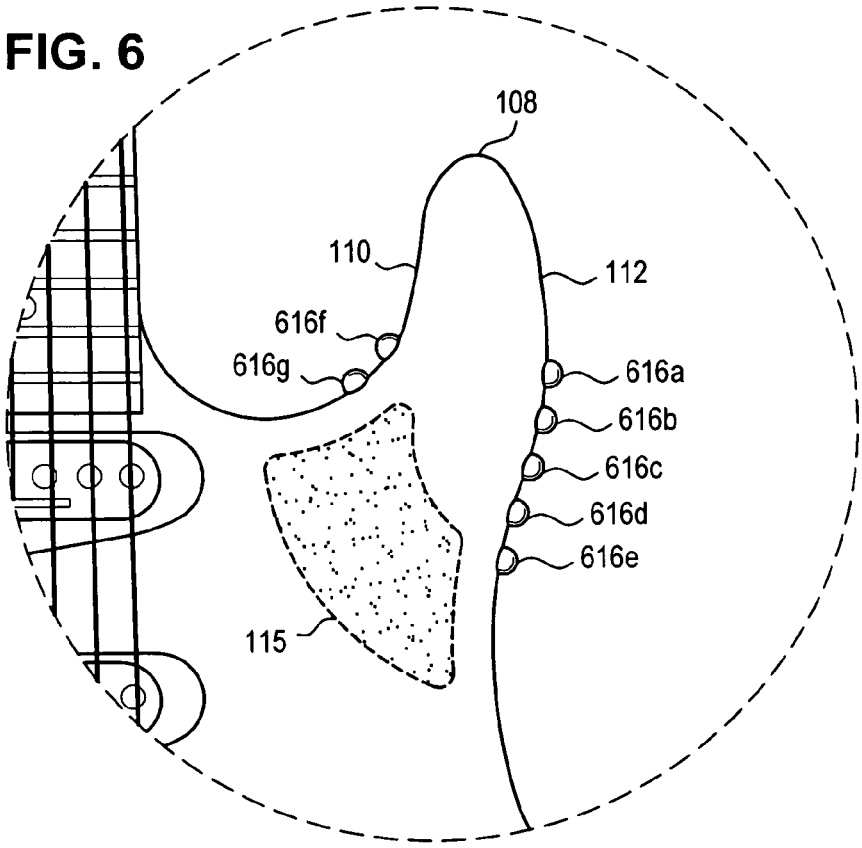
FIG. 6 is a front view of an alternative exemplary lower horn in accordance with an aspect of the present invention.

FIG. 6 depicts an alternative exemplary embodiment of the lower horn 108 of the guitar 100. The lower horn 108, as illustrated in FIG. 6, includes five nubs 616*a-e* on the outer portion 112 of the lower horn 108 and two nubs 216*f* and 216*g* on the inner portion 110 of the lower horn 108 that form the plurality of ridges 116 (FIG. 1) on the lower horn 108. In an exemplary embodiment, at least one nub (e.g., nubs 616*a-e*) on the outer portion 112 of the lower horn 108 is adapted to abut one or more of the fingers (e.g., fingers 304*a-d* of FIG. 3) of the hand 300 when the user grasps the lower horn 108. Additionally, at least one nub (e.g., nubs 616*f* and 616*g*) on the inner portion 110 of the lower horn 108 is adapted to abut the thumb 302 of the hand 300 of the user when the user grasps the lower horn 108. The nubs 216 of the lower horn 108 are a feature of the lower horn 108 adapted to conform to the hand 300 of the user when the user grasps the lower horn 108. This enables a user to firmly grip the lower horn 108 of the guitar 100 with their hand 300 in order to facilitate maneuvering of the guitar 100.

The lower horn 108 depicted in FIG. 6 may further include an optional raised portion 115 that abuts the palm of the hand 300 of the user when the user grasps the lower horn 108. The optional raised portion 115 forms an additional feature of the lower horn 108 adapted to conform to the hand 300 of the user when the user grasps the lower horn 108.

Figure 7:
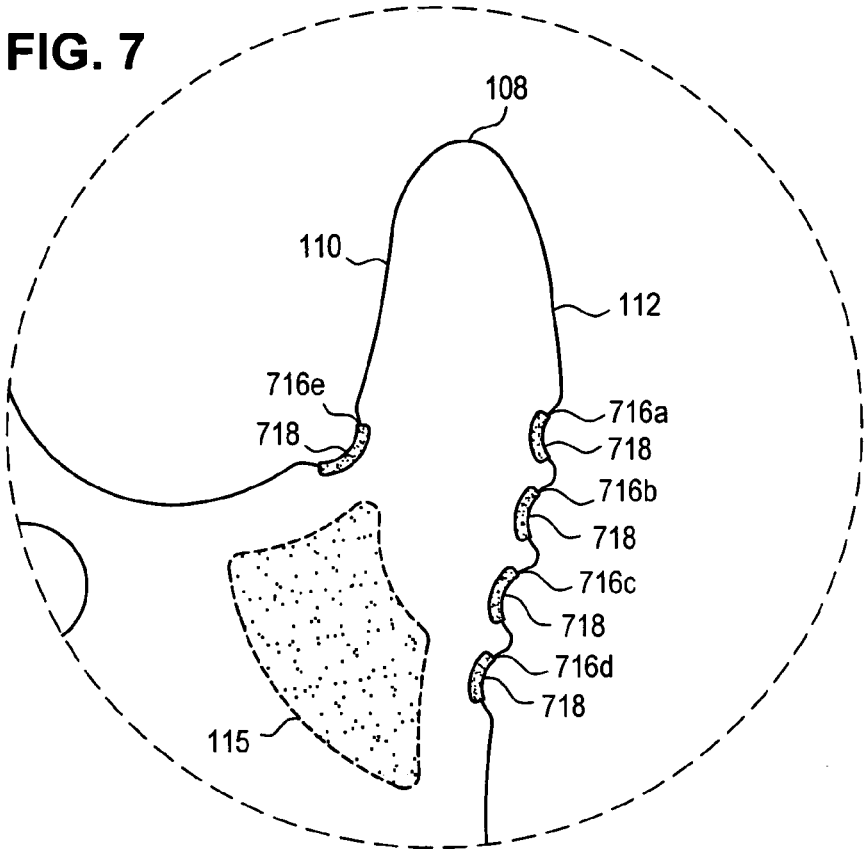
FIG. 7 is a front view of an alternative exemplary lower horn in accordance with an aspect of the present invention.

FIG. 7 depicts an alternative exemplary embodiment of the lower horn 108 of the guitar 100. The lower horn 108, as illustrated in FIG. 7, includes four indentations 716*a-d* on the outer portion 112 of the lower horn 108 and one optional indentation 716*e* on the inner portion 110 of the lower horn 108 that form the at least one feature adapted to conform to the hand 300 of the user for gripping the lower horn 108 in accordance with an aspect of the present invention. In an exemplary embodiment, at least one indentation (e.g., indentations 716*a-d*) on the outer portion 112 of the lower horn 108 is adapted to abut one or more fingers (e.g., fingers 304*a-d* of FIG. 3) of the hand 300 of the user when the user grasps the lower horn 108. Additionally, if present, the indentation 716*e* on the inner portion 110 of the lower horn 108 is adapted to abut the thumb 302 of the hand 300 of the user when the user grasps the lower horn 108. In an exemplary embodiment, at least one of the indentations 716 is at least partially filled with a gripping material 718 such as rubber. The lower horn 108 may optionally include a raised portion 115, which is discussed in further detail above.

Figure 8:
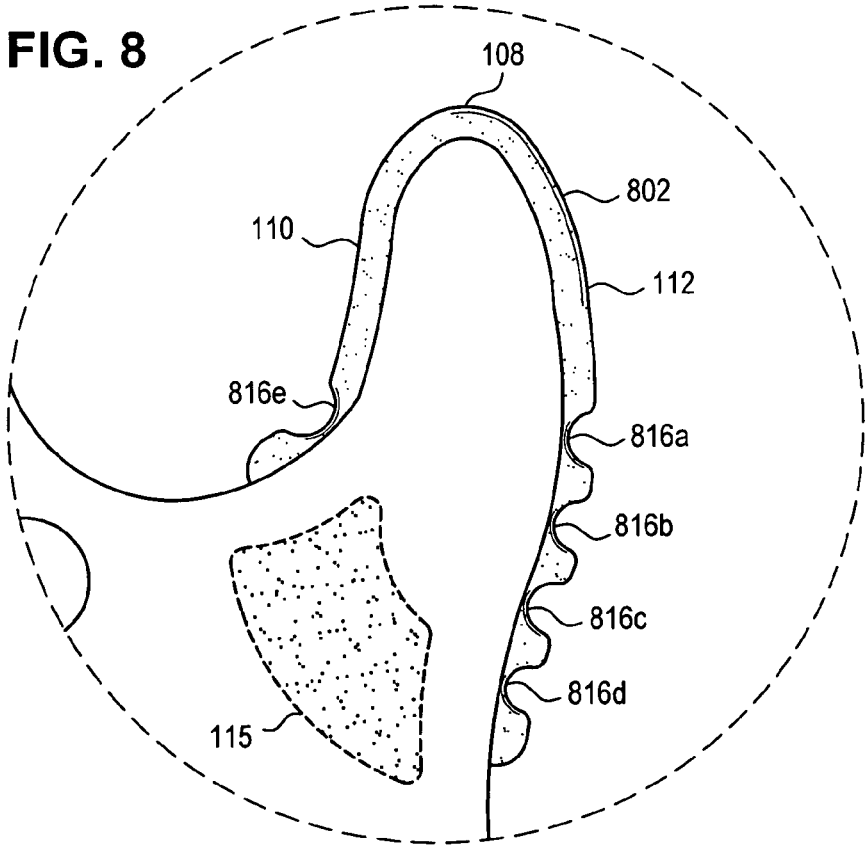
FIG. 8 is a front view of an alternative exemplary lower horn in accordance with an aspect of the present invention.

FIG. 8 depicts an alternative exemplary embodiment of the lower horn 108 of the guitar 100. The lower horn 108, as illustrated in FIG. 8, includes at least one piece of resilient material 802 (e.g., rubber) extending along the inner portion 110 of the lower horn 108 and along the outer portion 112 of the lower horn 108. The at least one piece of resilient materials 802 may be a single strip of material or multiple strips of material (not shown). For example, the at least one piece of resilient material may be two pieces of resilient material with a first piece positioned along the inner surface 110 of the lower horn 108 and a second piece positioned along the outer surface 112 of the lower horn 108.

The embodiment illustrated in FIG. 8 includes four indentations 816*a-d* in the resilient material 802 along the outer portion 112 of the lower horn 108 and one optional indentation 816*e* in the resilient material 802 along the inner portion 110 of the lower horn 108 that form the at least one feature adapted to conform to the hand 300 of the user for gripping the lower horn 108 in accordance with an aspect of the present invention. In an exemplary embodiment, at least one indentation (e.g., indentation 816*a-d*) along the outer portion 112 of the lower horn 108 is adapted to abut one or more fingers (e.g., fingers 304*a-d* for FIG. 3) of the hand 300 of the user when the user grasps the lower horn 108. Additionally, if present, the indentation 716*e* along the inner portion 110 of the lower horn 108 is adapted to abut the thumb 302 of the hand 300 of the user when the user grasps the lower horn 108. The indentations 816 may be formed within the resilient material 802 or the resilient material 802 may deform to form the indentations in response to pressure applied by the hand 300 when the user grasps the lower horn 108. The lower horn 108 may optionally include a raised portion 115, which is discussed in further detail above.

Figure 9A:
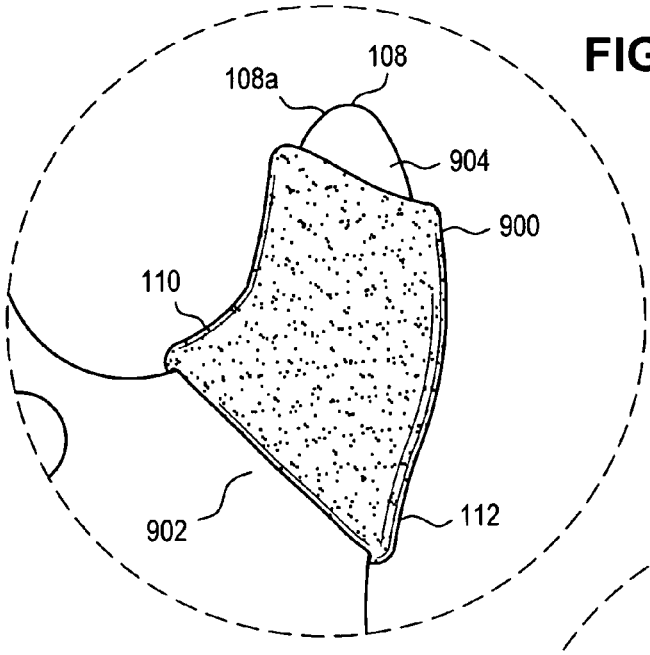
FIG. 9A is a front view of a deformable sleeve in accordance with aspects of the present invention.
Figure 9B:
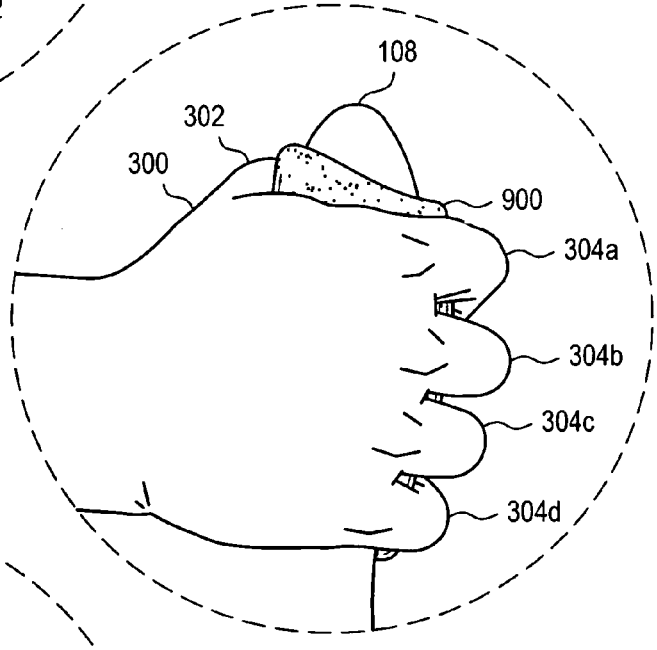
FIG. 9B is a front view of the deformable sleeve of FIG. 9A with a hand positioned thereon.
Figure 9C:
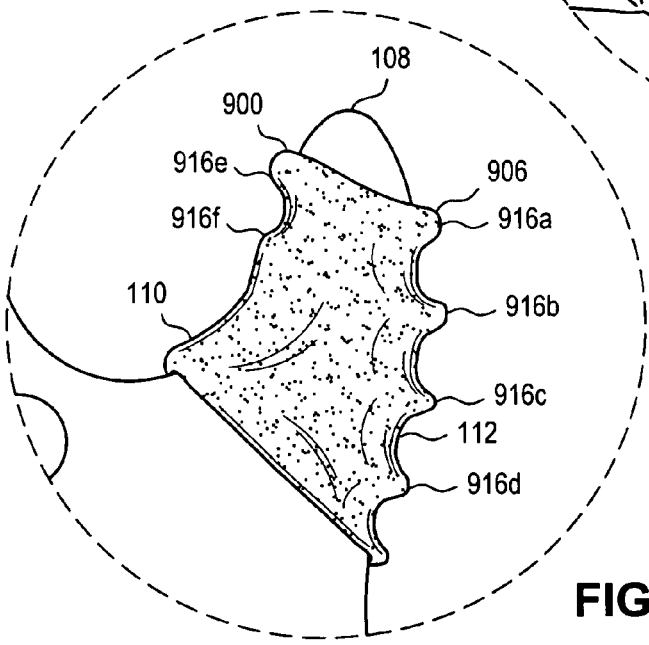
FIG. 9C is a front view of a formed sleeve in accordance with aspects of the present invention.

FIGS. 9A-9C are used to describe two embodiments of the present invention. In a first embodiment, with reference to FIGS. 9A and 9B, the at least one feature is a deformable sleeve 900 configured to deform to conform to the hand 300 of a user when the user grasps the deformable sleeve 900 as illustrated in FIG. 10B. The deformable sleeve includes a first opening 902 for positioning the deformable sleeve 900 over the lower horn 108 and an optional second opening 904 that allows a tip 108*a* of the lower horn 108 to extend entirely through the deformable sleeve 900. The deformable sleeve may be made of a material such as those used on bicycle handlebars. Other suitable materials will be understood by one of skill in the art from the description herein.

In a second embodiment, with reference to FIGS. 9A-9C, the at least one feature is a formed grip 906 that is formed from the deformable sleeve 900. In accordance with this embodiment, the deformable sleeve 900 is formed using a memory foam that deforms to form the formed grip 906, which conforms to the hand 300 of the use, when the user grasp the lower horn 108 and retains the deformed shape of the formed grip 906 after the user releases the lower horn 108. This allows the formed grip 906 to be customized to the hand 300 of a particular user.

The formed grip 906 includes four ribs 916*a-d* on the outer portion 112 of the lower horn 108 and two ribs 916*e* and 916*f* on the inner portion 110 of the lower horn 108 that form the plurality of ridges 116 (FIG. 1) on the lower horn 108. In an exemplary embodiment, at least one rib (e.g., ribs 916*a-d*) on the outer portion 112 of the lower horn 108 is adapted to abut one or more fingers (e.g., fingers 304*a-d*) of the hand 300 of the user when the user grasps the lower horn 108. Additionally, at least one rib (e.g., ribs 916*e* and 916*f*) on the inner portion 110 of the lower horn 108 is adapted to abut the thumb 302 when the lower horn 108 is grasp by the user. The ribs 916 of the lower horn 108 are a feature of the lower horn 108 adapted to conform to the hand 300 of the user when the user grasps the lower horn 108. This enables a user to firmly grip the lower horn 108 of the guitar 100 with their hand 300 in order to facilitate maneuvering of the guitar 100.

Although the invention is illustrated and described herein with reference to specific embodiments, the invention is not intended to be limited to the details shown. For example, the illustrated guitar 100 is a right handed guitar with the lower horn 112 positioned to the right of the neck 104 in FIG. 1. Those of skill in the art will recognize that the present invention is equally applicable for use with a left handed guitar in which the lower horn would be to the left of the neck 104. Various other modifications may be made in the details within the scope and range of equivalents of the claims and without departing from the invention.

What is claimed is:

1. A guitar comprising:

a main body; and a horn extending from the main body, the horn including at least one feature adapted to conform to a hand of a user;

wherein the at least one feature includes:

a plurality of rings encircling the horn adapted to conform to one or more fingers of the hand of the user and to a thumb of the hand of the user when the user grasps the horn.

2. A guitar comprising:

a main body;

a neck extending from the main body; and a horn extending from the main body that includes an inner portion facing the neck and an outer portion facing away from the neck, the horn including at least one feature adapted to conform to a hand of a user;

wherein the at least one feature includes at least one indentation within the outer portion adapted to abut one or more fingers of the hand of the user and an indentation in the inner portion adapted to abut a thumb of the hand of the user when the user grasps the horn; and wherein at least one of the indentations within the inner and outer portions is at least partially filled with a gripping material.

3. A guitar comprising:

a main body;

a horn extending from the main body, the horn including at least one feature adapted to conform to a hand of a user; and a neck;

wherein the horn includes an inner portion facing the neck and an outer portion facing away from the neck; and wherein the at least one feature includes at least one strip of material extending along at least a portion of the outer portion and along at least a portion of the inner portion adapted to abut one or more fingers of the hand of the user and to abut a thumb of the hand of the user when the user grasps the horn.

4. The guitar of claim 3, wherein the at least one strip of material is a deformable material that deforms to conform to the hand of the user when the user grasps the horn.

5. The guitar of claim 4, wherein the deformable material is a memory foam that deforms to form a deformed shape conforming to the hand of the user when the user grasps the horn and retains the deformed shape after the user releases the horn.

6. A guitar comprising:

a main body; and a horn extending from the main body, the horn including at least one feature adapted to conform to a hand of a user;

wherein the at least one feature includes a deformable material covering at least a portion of the horn configured to deform to conform to one or more fingers and to a thumb of the hand of the user when the user grasps the horn; and wherein the deformable material is a memory foam that deforms to form a deformed shape conforming to the hand of the user when the user grasps the horn and retains the deformed shape after the user releases the horn.

7. A guitar gripping apparatus for use with a guitar having a main body and a horn extending from the main body, the apparatus comprising:

an inner surface that abuts at least a portion of the horn when the apparatus is positioned on the horn; and an outer surface opposite the inner surface that includes at least one feature adapted to conform to a hand of a user when the apparatus is positioned on the horn and the user grasps the outer surface of the apparatus positioned on the horn;

wherein the horn includes a concave portion and a convex portion opposite the concave portion, the inner surface includes a convex surface corresponding to the concave portion and a concave surface corresponding to the convex portion; and the at least one feature includes at least one ridge on the outer surface in a first portion corresponding to the convex surface, the at least one ridge adapted to abut a thumb of the hand of the user when the apparatus is positioned on the horn and the user grasps the outer surface of the apparatus positioned on the horn; and the at least one feature further includes at least one ridge on the outer surface in a second portion corresponding to the concave surface, the at least one ridge adapted to abut one or more fingers of the hand of the user when the apparatus is positioned on the horn and the user grasps the outer surface of the apparatus positioned on the horn.

8. The apparatus of claim 7, wherein at least a portion of the outer surface includes a deformable material configured to deform to conform to the hand of the user when the apparatus is positioned on the horn and the user grasps the outer surface of the apparatus positioned on the horn.

9. The apparatus of claim 8, wherein the deformable material is a memory foam configured to deform to form a deformed shape that conforms to the hand of the user when the user grasps the outer surface of the apparatus positioned on the horn and to retain the deformed shape after the user releases the outer surface of the apparatus positioned on the horn.

10. The apparatus of claim 7, wherein the at least one feature includes:

at least one ridge adapted to abut one or more fingers and a thumb of the user when the apparatus is positioned on the horn and the user grasps the outer surface of the apparatus positioned on the horn.

11. The apparatus of claim 7, wherein the apparatus covers at least a portion of the concave portion and the convex portion of the horn.

12. The apparatus of claim 11, wherein the portion includes at least one strip extending along one or more portions of the concave portion and the convex portion.

13. A guitar including the guitar gripping apparatus of claim 7.

14. A guitar comprising:

a main body;

a neck extending from the main body;

a horn extending from the main body that includes an inner portion facing the neck and an outer portion facing away from the neck, wherein the horn is a lower horn of the guitar when the guitar is in use by the user; and a gripping member extending over a portion of the horn and being of a different material than the horn, the gripping member includes an inner portion facing the neck and an outer portion facing away from the neck, the outer portion including a plurality of ridges to abut one or more fingers of a hand of a user and the inner portion including two ridges to abut a thumb of the hand of the user when the user grasps the horn.

* * * * *